US006582292B1

(12) United States Patent
Bastian

(10) Patent No.: US 6,582,292 B1
(45) Date of Patent: Jun. 24, 2003

(54) FUME HOOD WITH ROTATABLE AIRFOIL

(75) Inventor: John M. Bastian, Manitowoc, WI (US)

(73) Assignee: Fisher Hamilton, Inc., Two Rivers, WI (US)

( * ) Notice: Subject to any disclaimer, the term of this patent is extended or adjusted under 35 U.S.C. 154(b) by 0 days.

(21) Appl. No.: 10/014,675

(22) Filed: Dec. 11, 2001

(51) Int. Cl.[7] ..... B08B 15/02

(52) U.S. Cl. ..... 454/59; 454/56; 454/57; 454/58

(58) Field of Search ..... 454/56, 57, 58, 454/59, 61, 62

(56) References Cited

U.S. PATENT DOCUMENTS

| | | | | | |
|---|---|---|---|---|---|
| 2,702,505 | A | * | 2/1955 | Nelson | 126/299 R |
| 3,726,206 | A | * | 4/1973 | Worick, Jr. | 454/56 |
| 3,874,754 | A | * | 4/1975 | Saunders et al. | 312/209 |
| 4,023,473 | A | * | 5/1977 | Russell | 454/59 |
| 4,280,400 | A | * | 7/1981 | Longworth | 454/57 |
| 4,409,890 | A | * | 10/1983 | Longworth | 454/57 |
| 5,334,089 | A | * | 8/1994 | Beck et al. | 454/347 |
| 5,556,331 | A | | 9/1996 | Bastian | 454/56 |
| 6,080,058 | A | * | 6/2000 | Coe et al. | 312/209 |
| 6,302,779 | B1 | * | 10/2001 | Ryan et al. | 454/56 |

FOREIGN PATENT DOCUMENTS

| | | | | |
|---|---|---|---|---|
| EP | 0 486 971 | * | 5/1992 | 454/56 |

* cited by examiner

*Primary Examiner*—Harold Joyce
(74) *Attorney, Agent, or Firm*—Rader, Fishman & Grauer PLLC

(57) ABSTRACT

A fume hood includes a top, bottom sidewalls, front panel and a back panel that define an enclosed workspace. The fume hood also includes a movable sash for opening and closing an access opening and an airfoil disposed proximate an edge portion of the opening to direct airflow through the opening and into the workspace. The airfoil is automatically raised from a down position to an up position when the sash is raised to a predetermined height. In addition, the airfoil may be automatically raised when the velocity of the airflow into the access opening decreases below a predetermined value. Once raised, the airfoil may be automatically or manually lowered to the down position. In one embodiment, the airfoil includes one or more fins having an angled portion that extends downwardly below the work surface of the fume hood when the airfoil is in the down position, thereby reducing the possibility of a potential spill when the technician removes an item from the workspace.

13 Claims, 3 Drawing Sheets

Fig. 2
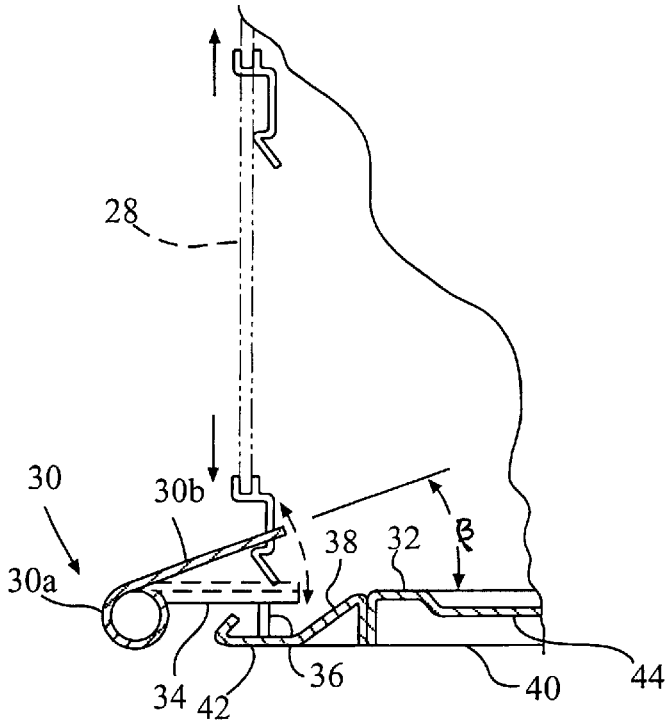
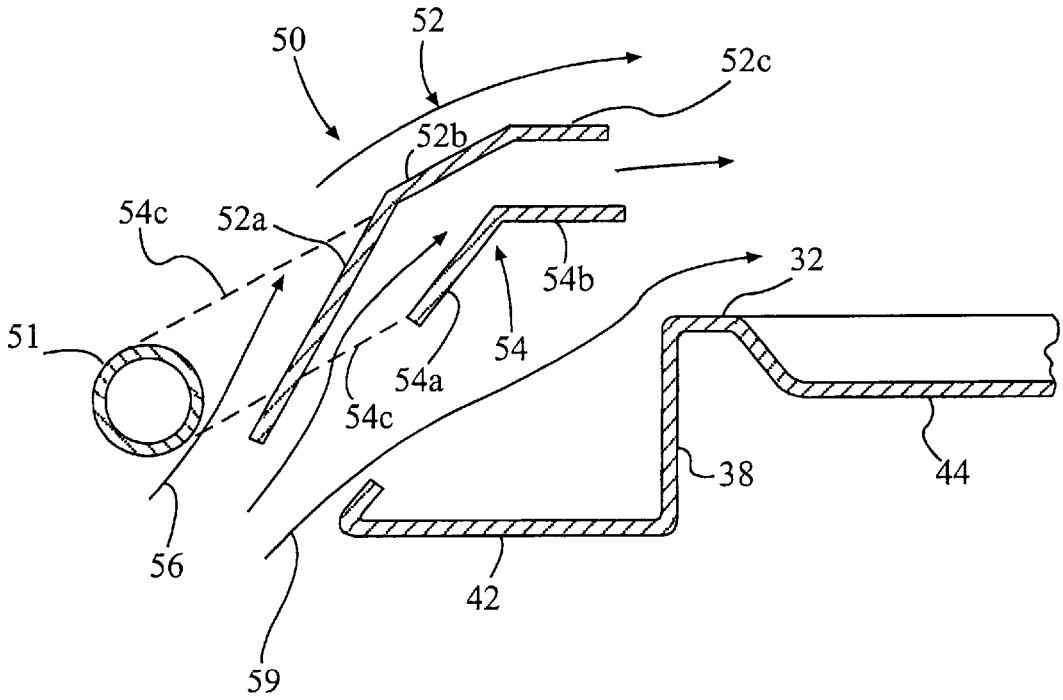
Fig. 4

FUME HOOD WITH ROTATABLE AIRFOIL

BACKGROUND OF THE INVENTION

1 Field of the Invention

The present invention relates to a fume apparatus, and in particular to a fume hood apparatus with a rotatable airfoil member that improves the containment performance of the fume hood apparatus and reduces the probability of the occurrence of spills, thereby improving safety during operation of the fume hood apparatus.

2 Description of the Related Art

Fume hoods are protective enclosures that provide ventilated and illuminated workspaces for laboratory or other applications. A fume hood in its most basic form is a box with an inlet and an outlet. The inlet generally has a movable sash capable of moving vertically or a combination of vertically and horizontally, which provides an opening that allows access to the workspace. The procedures performed inside the fume hood are exhausted at the back through the top of the fume hood to a heating, venting and air conditioning (HVAC) system.

In some fume hood designs, an airfoil is mounted in a pivotal manner at the front of the work surface. Typically, the airfoil is flush or coplanar with the fume hood's work surface to provide a substantially unobstructed path for moving items in and out of the fume hood. When the airfoil is rotated to an up position, the direction of the airflow pattern is changed to improve the containment of airborne contaminants. However, there is a problem with a raised airfoil in that the technician may accidentally catch an item, for example, a beaker on the edge of the airfoil when the technician is removing the beaker, thereby increasing the probability of a spill.

The inventors of the present invention have recognized that it is beneficial to automatically rotate the airfoil up and down when the sash is lower than a predetermined height and so as to minimize the potential for a spill when the technician is removing items from the workspace of the fume hood.

SUMMARY OF THE INVENTION

The present invention comprises a fume hood apparatus including an enclosure, a movable sash and an airfoil member for directing airflow through the opening and along the fume hood's work surface. The airfoil member is automatically raised to a first position when the movable sash is positioned above a predetermined height above the bottom of the fume hood apparatus to effectively evacuate the work surface and the workspace of fumes and other waste materials. When the movable sash is positioned at or below the predetermined height, the airfoil member is automatically lowered to a second position that is flush or co-planar with the work surface, thereby minimizing the possibility of an accident when the technician removes an item from the workspace. Also, the airfoil member can be automatically raised or lowered when a velocity of the airflow through the access opening decreases below a predetermined value.

In another aspect of the invention, the airfoil member includes one or more fins for directing the airflow through the opening and along the work surface. The fins may include one or more angled portions such that a portion of the airfoil member is positioned below the work surface when the airfoil members are in the second position.

Various aspects and advantages of this invention will become apparent to those skilled in the art from the following detailed description of the preferred embodiment, when read in light of the accompanying drawings.

BRIEF DESCRIPTION OF THE DRAWINGS

FIG. 2 is a cross-sectional view taken along line 2—2 of FIG. 1; FIG. 4 is an end view of the airfoil of FIG. 3 when in the up position.

DESCRIPTION OF THE PREFERRED EMBODIMENT

Figure 1:
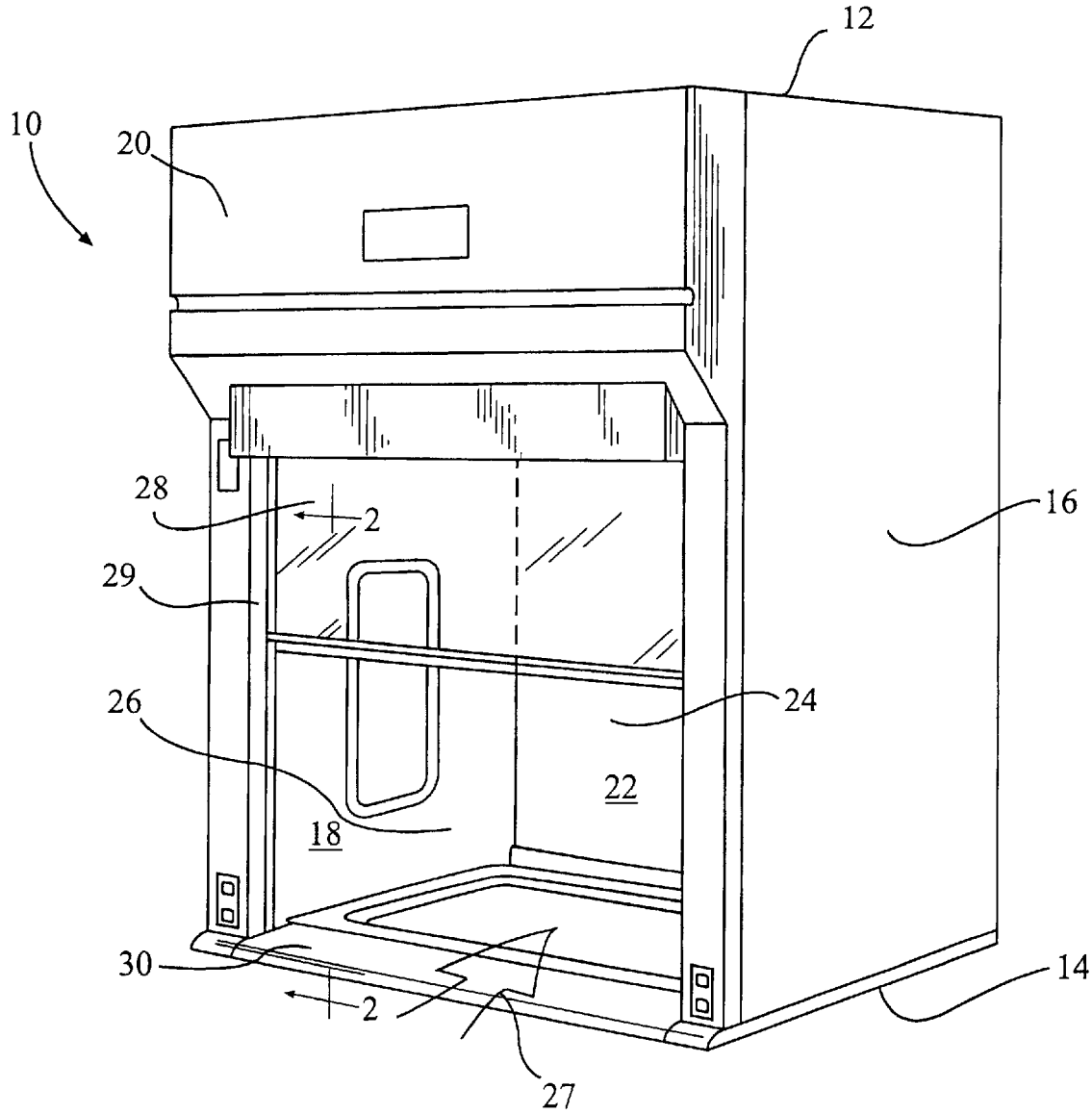
FIG. 1 is a perspective view of the fume hood apparatus of the present invention.

Referring now to FIGS. 1–4, a fume hood apparatus is shown generally at 10 according to the present invention. The fume hood apparatus 10 generally includes an enclosure comprising a cover or top 12, a bottom 14 opposite the top 12, sidewalls including a first end panel 16, a second end panel 18 opposite the first end panel 16, a front panel 20, and a back panel 22 opposite the front panel 20. The enclosure may be made of metal or any other material of high strength and rigidity.

The enclosure defines a workspace 24 and an access opening 26 through which a technician may reach into the workspace 24. A moveable sash 28 is slidably mounted to the enclosure in a frame member 29 to allow closing the opening 26 and precluding access to the workspace 24. The sash 28 is preferably made of glass or any other similar material. The technician may raise the sash 28 to allow access through the opening 26 and air to flow into the workspace 24, as indicated by the arrow 27 in FIG. 1, or the technician may lower the sash 28 to close the opening 26.

The fume hood apparatus 10 may include a baffle system (not shown) that cooperates with a fan (not shown) to evacuate the fumes generated in the workspace 24. Typically, the baffle system lies at the back of the workspace 24 and directs the fumes to a discharge conduit (not shown). As the fan draws the air and fumes out of the workspace 24, ambient air flows into the workspace 24, primarily through the opening 26. The bottom 14 defines a work surface that is used for positioning the fume hood apparatus 10 at a desired elevation for the technician. It will be understood that the invention is not limited by the type of baffle system, base member or airfoil, and that the invention can be practiced with any type of baffle system and base member well known in the art. Examples of a baffle system and base member are described in U.S. Pat. No. 5,556,331 to Bastian, the entire contents of which are herein incorporated by reference.

Figure 3:
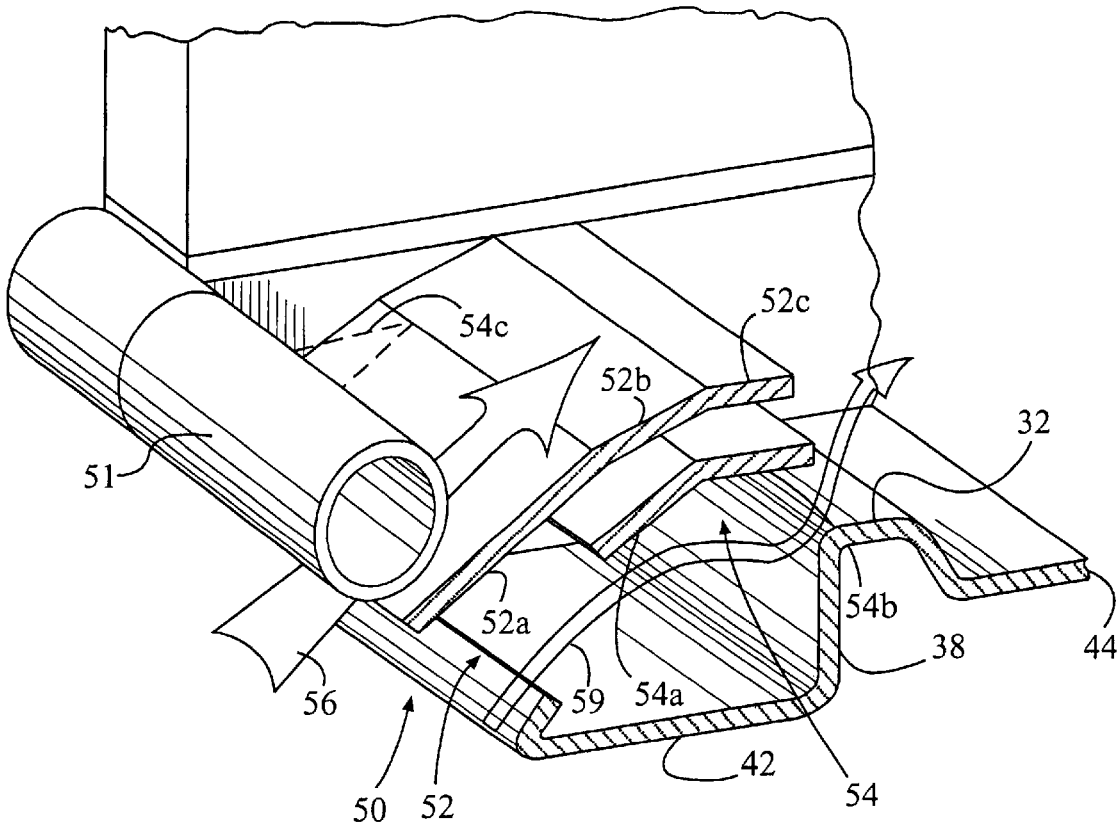
FIG. 3 is a cutaway perspective view of an alternate embodiment of the airfoil of the invention when in the down position.

Referring now to FIGS. 2–4, an airfoil member 30 according to a first embodiment of the invention is shown. The airfoil member 30 is preferably located in the bottom of the access opening 26 and extends the length of the access opening 26. In general, the airfoil member 30 includes a tube portion 30*a*and a flat portion 30*b* that provide that airfoil member 30 with an aerodynamic shape that facilitates the movement of air into the workspace 24. The tube portion 30*a* may receive enclosure protuberances (not shown) that function as an axle at the ends of the airfoil member 30. Alternatively, the tube portion 30*a* may be slightly longer than the other portions of the airfoil member 30 so that its end portions may extend into pockets (not shown) in the enclosure.

The airfoil member 30 is pivotally mounted at one end to the enclosure to allow the airfoil member 30 to be rotated by the technician from an up position (shown as solid lines in FIG. 2) to a down position (shown in phantom in FIG. 2). In the up position, the airfoil member 30 directs air into the workspace 24 by allowing air to flow over and under the airfoil member 30 and into the workspace 24. In the down position, the airfoil member 30 is substantially flush or co-planar with the fume hood's work surface 32 to allow better access to the workspace 24. This arrangement allows incoming air to move fumes and other waste off of the work surface 32 and to the back of the work space 24 where the fan can discharge them from the fume hood apparatus 10.

One feature of the invention is that the airfoil member 30 is automatically raised to the up position when the movable sash 28 is positioned, for example, at or above a minimum height, "h", in a range of about 10 to 24 inches above the bottom 14 of the fume hood apparatus 10. Automatically raising the movable sash 28 can be accomplished by any means, such as a limit switch (not shown) on a corner post of the fume hood 10, or the like. It will be appreciated that the invention is not limited by the minimum height, "h", at which the airfoil member 30 will be raised because the surface area of the access opening 26 varies according to the width of the movable sash 28.

It will also be appreciated that this feature of the invention decreases the probability of accidents by a technician when removing an object from the workspace 24 as compared to conventional fume hood designs because the airfoil member 30 is raised only when the movable sash 28 is positioned at or above the minimum height, "h". Also, the airfoil member 30 can be automatically raised to the up position when the velocity of the airflow through the access opening 26 decreases below a predetermined value, for example, in a range between about 50 to about 100 feet/minute. Raising or lowering the airfoil member 30 can be accomplished by any means, such as by use of an airflow sensor (not shown), or the like.

Another feature of the invention is that the airfoil member 30 is automatically raised to an angle, "β", with respect to the bottom 14 of the fume hood apparatus 10 that optimizes an amount of airflow into the workspace 24. Preferably, the angle, "β", is in a range between about 10 degrees and about 30 degrees, and more preferably about 20 degrees. However, it will be appreciated that the angle, "β", will vary according to the dimensions of the workspace 24. This feature of the invention ensures that the airfoil member 30 will be raised to maintain fume containment even though the movable sash 28 is positioned at or above the minimum distance, "β", from the bottom 14.

A shelf 34 supports the airfoil member 30 in the down position and acts as a stop to prevent further clock-wise rotation of the airfoil member 30. The shelf 34 rests on-pins 36 (only one pin 36 is shown in FIG. 2) that lie on a top segment 38 of a base member 40 at predetermined intervals along the length of the shelf 34. It should be noted that the shelf 34 is co-extensive with the airfoil member 30.

The top segment 38 of the base member 40 is a plate-like structure that defines the work surface 32. The top segment 38 also defines a trough 42 generally disposed below the shelf 34 and another trough 44 disposed inwardly of the trough 42. The troughs 42, 44 collect liquid run-off from the work surface 32.

FIGS. 3 and 4 show an airfoil member 50 according to an alternate embodiment of the present invention. Similar to the first embodiment, the airfoil member 50 includes a rounded portion 51. However, unlike the first embodiment, the airfoil member 50 includes a first fin 52 having a first angled portion 52*a*, a second angled portion 52*b* and a third angled portion 52*c*. In addition, the airfoil member 50 includes a second fin 54 including a first angled portion 54*a* and a second angled portion 54*b*. The airfoil member 50 also includes a means 54*c* for connecting the rounded portion 51 and the first and second fins 52, 54 together such that rotating the rounded portion 51 causes the first and second fins 52, 54 to rotate in unison with the rounded portion 51. In the illustrated embodiment, the connecting means comprises a substantially perpendicular plate 54*c* (shown in phantom) that is bonded to the rounded portion 51 and the first and second fins 52, 54 using any well known means, such as welding, or the like. It will be appreciated that the number of fins does not limit the invention, and that the invention can be practiced with any desirable number of fins to provide an optimum amount of airflow into the workspace.

As shown in FIG. 3, the first and third angled portions 52*a*, 52*c* are positioned below the work surface 32 and the second angled portion 52*b* is flush or co-planar with the work surface 32 when the airfoil member 50 is in the down position. Because of the position of the first and third angled portions 52*a*, 52*c* are positioned below the work surface 32, the probability of accidents by a technician when removing an object from the workspace 24 is decreased as compared to conventional fume hood designs. When the airfoil member 50 is in the down position, the air flows under the rounded portion 51 and over the first fin 52 of the airfoil member 50, as indicated by arrow 56, to increase airflow into the workspace 24. In addition, the air flows under the first fin 52 and over the second fin 54, as indicated by the arrow 59, to also increase airflow into the workspace 24. In particular, the airflow is increased along the bottom 14 of the workspace 24, thereby preventing fumes from escaping from the workspace 24.

FIG. 4 illustrates when the airfoil member 50 is in the up position. When in the up position, the air flows under the rounded portion 51 and over the first fin 52 as when the airfoil member 50 is in the down position (shown in FIG. 3). In addition, the air flows under and over the second fin 54 to increase the amount of airflow into the workspace 24, and in particular, into the bottom 14 of the workspace 24. Similar to the first embodiment of the airfoil member 30, the airfoil member 50 is raised to the up position from the down position automatically when the movable sash 28 is raised to the minimum height, "h", above the bottom 14 of the fume hood apparatus 10. In addition, the airfoil member 50 is lowered to the down position from the up position when the movable sash 28 is lowered to the minimum height, "h", about the bottom 14 of the fume hood apparatus 10.

While the invention has been specifically described in connection with certain specific embodiments thereof, it is to be understood that this is by way of illustration and not of limitation, and the scope of the appended claims should be construed as broadly as the prior art will permit.

What is claimed is:

1. A fume hood apparatus, comprising:

an enclosure defining a workspace and an access opening;

a movable sash for closing the access opening; and an airfoil member for directing air flow through the opening and into the workspace, wherein the airfoil member automatically rotates from a first position to a second position when the movable sash is positioned at or below a predetermined height from a bottom of the fume hood apparatus.

2. The fume hood apparatus of claim 1, wherein the predetermined height is in a range of approximately 10 to 24 inches.

3. A fume hood apparatus, comprising:

an enclosure defining a workspace and an access opening;

a movable sash for closing the access opening; and an airfoil member for directing air flow through the opening and into the workspace, wherein the airfoil member automatically rotates from a first position to a second position when a velocity of the air flow through the access opening decreases below a predetermined value.

4. The fume hood apparatus of claim 3, wherein the predetermined value is in a range of about 50 to about 100 feet/minute.

5. A fume hood apparatus, comprising:

an enclosure defining a workspace and an access opening;

a movable sash for closing the access opening; and an airfoil member including two or more fins having a plurality of angled portions for directing air flow through the opening and into the workspace, wherein the airfoil member automatically rotates between a first position and a second position, and wherein at least one of the angled portions being positioned below a work surface when the airfoil member lies in the second position.

6. The fume hood apparatus of claim 5, wherein the airfoil member rotates between the first position to the second position when the movable sash is positioned at or below a predetermined height from a bottom of the fume hood apparatus.

7. The fume hood apparatus of claim 6, wherein the predetermined height is in a range of approximately 10 to 24 inches.

8. The fume hood apparatus of claim 5, wherein the airfoil member rotates between the first position to the second position when a velocity of the air flow through the access opening decreases below a predetermined value.

9. The fume hood apparatus of claim 8, wherein the predetermined value is approximately in a range of about 50 to about 100 feet/minute.

10. A method of minimizing airborne contaminants from escaping through the face of a fume hood apparatus, the fume hood apparatus including an enclosure defining a workspace and an access opening, a movable sash for closing the access opening, and an airfoil member, the method comprising the steps of:

automatically raising or lowering the airfoil member to direct the airflow along a work surface of the fume hood apparatus, thereby effectively evacuating the work surface and the workspace of fumes, wherein the airfoil member is automatically raised or lowered when the movable sash is positioned at a predetermined height above the work surface.

11. The method according to claim 10, wherein the predetermined height is in a range of approximately 10 to 24 inches.

12. A method of minimizing airborne contaminants from escaping through the face of a fume hood apparatus, the fume hood apparatus including an enclosure defining a workspace and an access opening, a movable sash for closing the access opening, and an airfoil member, the method comprising the steps of:

automatically raising or lowering the airfoil member to direct the airflow along a work surface of the fume hood apparatus, thereby effectively evacuating the work surface and the workspace of fumes, wherein the airfoil member is automatically raised or lowered when a velocity of airflow through the access opening falls below a predetermined value.

13. The method according to claim 12, wherein the predetermined value is approximately in a range of about 50 to about 100 feet/minute.

* * * * *